US005163737A

United States Patent [19]

Navach et al.

[11] Patent Number: 5,163,737

[45] Date of Patent: Nov. 17, 1992

[54] CUSHION

[75] Inventors: Joseph H. Navach, Van Nuys; Robert E. Phillips, N. Hollywood; Robert M. Felton, Calabasas, all of Calif.

[73] Assignee: The BBJ Connection, North Hollywood, Calif.

[21] Appl. No.: 647,248

[22] Filed: Jan. 29, 1991

[51] Int. Cl.[5] ..... A47C 7/02

[52] U.S. Cl. ..... 297/459; 297/DIG. 1; 297/DIG. 3; 297/452; 5/481; 5/453

[58] Field of Search ..... 297/DIG. 1, DIG. 3, 297/284 E, 452, 457–459; 5/446, 447, 462, 481, 453, 464, 653, 654

[56] References Cited

U.S. PATENT DOCUMENTS

| | | | |
|---|---|---|---|
| 3,000,020 | 9/1961 | Lombard et al. | 5/481 |
| 3,110,520 | 11/1963 | Herding | 297/284 E |
| 3,326,601 | 6/1967 | Vanderbilt et al. | 5/453 X |
| 3,644,950 | 2/1972 | Lindsay, Jr. | 5/447 |
| 3,751,111 | 8/1973 | Taylor et al. | 297/457 X |
| 3,982,786 | 9/1976 | Burgin et al. | 297/DIG. 3 X |
| 4,027,843 | 6/1977 | Thompson | 297/DIG. 1 X |
| 4,039,363 | 8/1977 | Robertson | 297/DIG. 1 X |
| 4,132,228 | 1/1979 | Green | 297/DIG. 3 X |
| 4,588,229 | 5/1986 | Jay | 297/459 |
| 4,615,563 | 10/1986 | Kobayashi | 297/DIG. 3 X |
| 4,627,664 | 12/1986 | Okazaki et al. | 297/DIG. 1 X |
| 4,643,481 | 2/1987 | Saloff et al. | 5/653 X |
| 4,753,480 | 6/1988 | Morell | 297/459 X |
| 4,856,844 | 8/1989 | Iseno | 297/458 X |
| 5,018,790 | 5/1991 | Jay | 297/459 X |

FOREIGN PATENT DOCUMENTS

| | | | |
|---|---|---|---|
| 0318730 | 6/1989 | European Pat. Off. | 5/481 |
| 3812916 | 10/1989 | Fed. Rep. of Germany | 297/DIG. 1 |
| 0342428 | 2/1931 | United Kingdom | 297/459 |

*Primary Examiner*—Kenneth J. Dorner
*Assistant Examiner*—Milton Nelson, Jr.
*Attorney, Agent, or Firm*—Allen A. Dicke, Jr.

[57] ABSTRACT

The cushion has a contoured base with a layer of resilient cushion foam thereover. The cushion foam is of uniform thickness over a substantial part of the base and is suitably covered. The shape is such that the buttocks of the seated person are clasped positioned rather than supported. A recess is provided under the ischia, under the trochanters, and beneath the sciatic nerves to limit the local pressure. In one configuration, these recesses may contain air bladders which are inflated by body motion against a back bladder in the cushion. In another embodiment, the various bladders may be sequentially pressurized to shift the bearing areas under the buttocks of the seated user in order to periodically lift the user for stimulating blood circulation.

14 Claims, 4 Drawing Sheets

CUSHION

FIELD OF THE INVENTION

The localized pressure limiting seat cushion is particularly suited for those who are sedentary for long periods of time, for example, wheelchair users. The cushion limits pressure where it is most harmful and shifts pressure to aid circulation.

BACKGROUND OF THE INVENTION

There are some persons who are sedentary for long periods of time. A particular class of these persons are those who use wheelchairs. Those who are confined to wheelchairs become emaciated in their lower extremities so that they are further subject to discomfort, fatigue, pain, and ultimately ulcers.

There has been a multiplicity of contoured chairs, cushions and seats which have been designed to improve the comfort of those persons required to sit for long periods of time.

Doctors have been troubled with the problems of patients who spend long periods of time in wheelchairs. Those patients who have emaciated lower extremities or paralysis often have little sense of feeing in their posterior, and consequently cannot determine when inadequate circulation is leading to deterioration. Pressure problems initiate at the points on the posterior where the bone structure of the seated patient is close to the supporting surface, such as is in the case of the ischial tuberosities and trochanters. Previous attempts to solve these localized pressure problems have not recognized the importance of proper weight distribution across the surfaces of the gluteal region, and particularly maximum and minimum surface pressures over the various areas. While these concepts are particularly useful for wheelchair users who may have emaciated lower extremities and/or limited sense of feeling in the posterior, these concepts are also useful for others who are sedentary for long periods of time.

SUMMARY OF THE INVENTION

In order to aid in the understanding of this invention, it can be stated in essentially summary form that it is directed to a localized pressure limiting seat cushion, and particularly a seat cushion which has a contoured surface for support of a seated person wherein the contour is such that the buttocks are clasped, the thighs are clasped, and there are recesses under areas subject to higher pressure to reduce the pressure therein to a limited value. The recesses may include fluid bladders which ca be pumped up to a limited value or sequentially pumped up to shift the load on the different regions of posterior to encourage subcutaneous blood circulation.

It is, thus, an object and advantage of this invention to provide a cushion to support those who are sedentary for long periods of time in a manner which is not detrimental to their skin condition, by providing proper support and proper pressure relief in selected areas.

It is another object and advantage of this invention to provide a static cushion wherein the buttocks are clasped rather than merely supported to provide force vectors on the sides and back of the buttocks to leave the ischia partially unsupported.

It is a further object and advantage of this invention to provide a cushion with contoured areas which have a clasping effect on the thighs. These areas have a relief declivity beneath the sciatica, thus allowing more of the weight to be distributed to the thighs. This design provides more even weight distribution than conventional seating without sciatic distress and inhibits forward motion of the buttocks to hold the buttocks in place.

It is a further object and advantage of this invention to provide a shaped recess under the ischia to provide adequate support to avoid hemorrhoid formation, but with low enough pressure to avoid ulceration.

It is another object and advantage of this invention to provide a cushion and a process by which the pelvic position and lumbar-sacral position can be controlled to reduce particular areas of posterior pressure for the seated patient to retard bony displacement of soft tissues to thus reduce both local pressure and pressure gradients to provide a unique cushion of superior comfort and limitation of distress.

It is a further object and advantage of this invention to provide bladders in the cushion, with a back bladder pumping air into the other bladders and with a pressure relief valve to avoid overpressure whereby the bladders are pumped up by motion of the seated person.

It is another object and advantage of this invention to provide a cushion wherein each of a plurality of bladders positioned for clasp and support is sequentially pressurized to change the pressure against the body by these bladders so a to promote subcutaneous blood circulation.

Other purposes and advantages of this invention will become apparent from a study of the following portion of the specification, the claims and the attached drawings.

DESCRIPTION OF THE PREFERRED EMBODIMENTS

Figure 1:
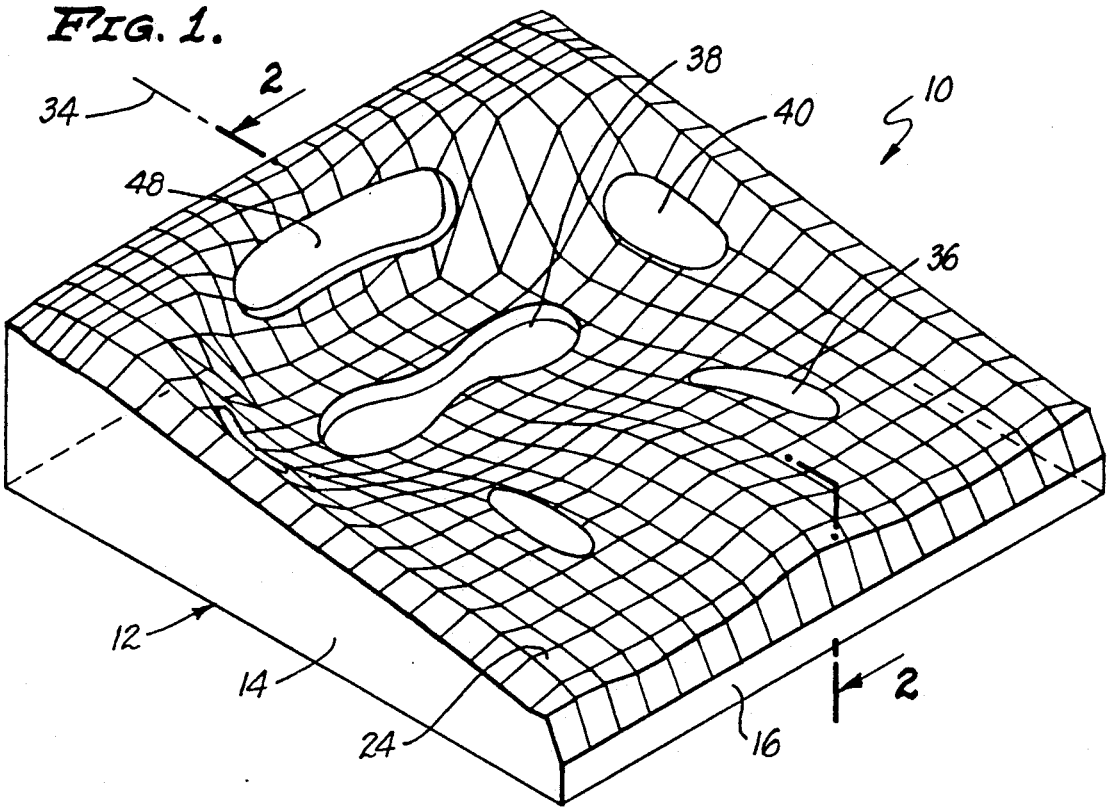
FIG. 1 an isometric view of the first preferred embodiment of the cushion of this invention, with contour lines showing surface contour of the cushion.
Figure 2:
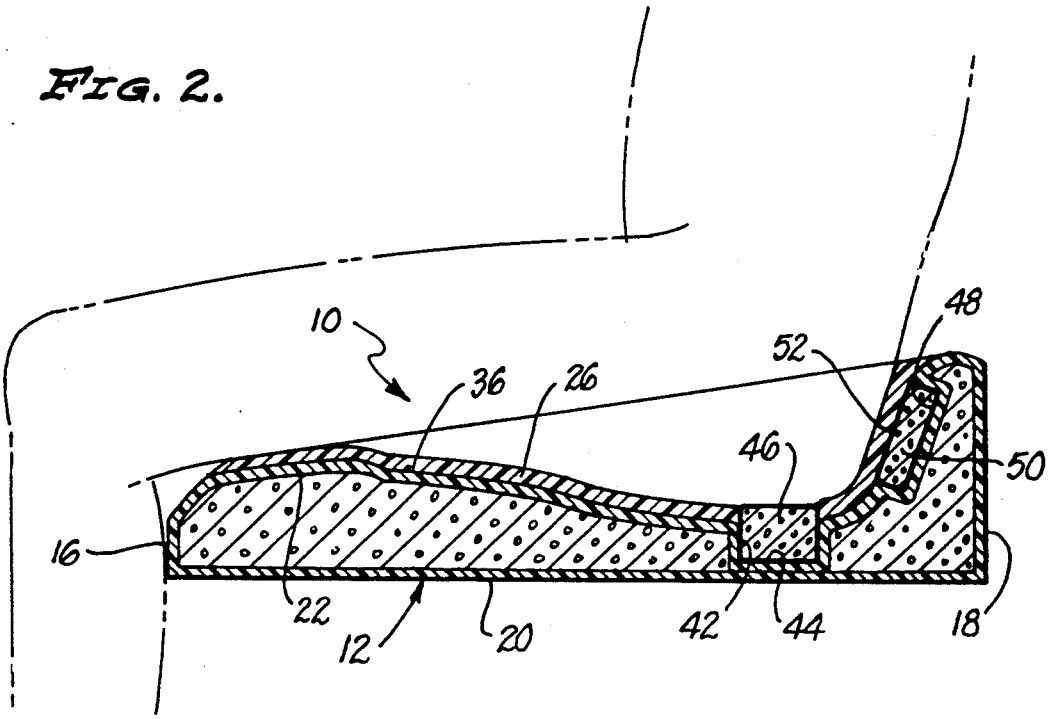
FIG. 2 is a partial center line section taken generally along 2—2 of FIG. 1.
Figure 3:
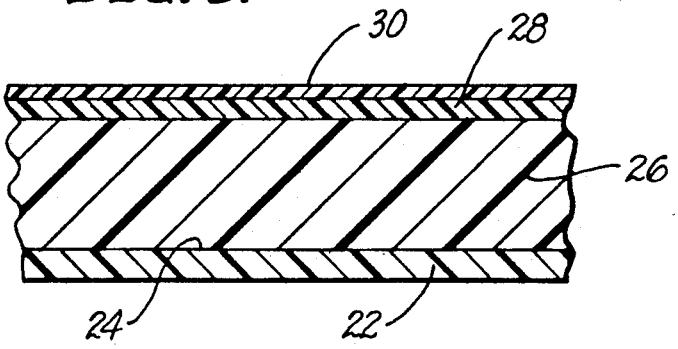
FIG. 3 is an enlarged section through the upper surface of the contoured base, the resilient cushion foam and the covering thereon.

FIGS. 1 and 2 show the first preferred embodiment of the cushion of this invention where it is generally indicated at 10. The cushion 10 has a substantially rigid contoured base 12, which is seen in partial center line section in FIG. 2. The cushion and base are symmetrical about a vertical plane on the front-to-back center line, which in the back portion of the cushion is the plane of the section of FIG. 2. Base 12 may be structured in any convenient way. As shown in FIGS. 1 and 2, it is substantially square in plan with a right side 14, front 16, back 18, and bottom 20. The top 22 of the contoured base has a contoured top surface 24, which has the critical contours and recesses therein to provide the desired support contour. As seen in FIG. 3, the top 22 is a structural member. It carries a contoured foam layer 26 of uniform thickness, preferably about ½ inch in the preferred embodiment. The foam cushion layer 26 is of upholstery foam material which is considered to be closed cell foam, but it is only partially closed cell foam. A preferred material is EV acetate. In order to protect the foam layer 26, it is covered with a flexible polymer upholstery layer 28 resembling a synthetic leather, such as "Naugahyde®." In order to provide washability, the outside layer 30 is a stretchy synthetic polymer fabric layer which slides freely over the "Naugahyde®" to reduce shear forces and which is removable for washing. "Lycra®" or nylon are suitable when provided as an elastic knit fabric.

The surface contour is critical. In addition to the criticality of the surface contour, there are recessed areas over the cushion which have a different, softer pressure so as to provide selected areas of reduced pressure on the posterior of the user.

Figure 5:
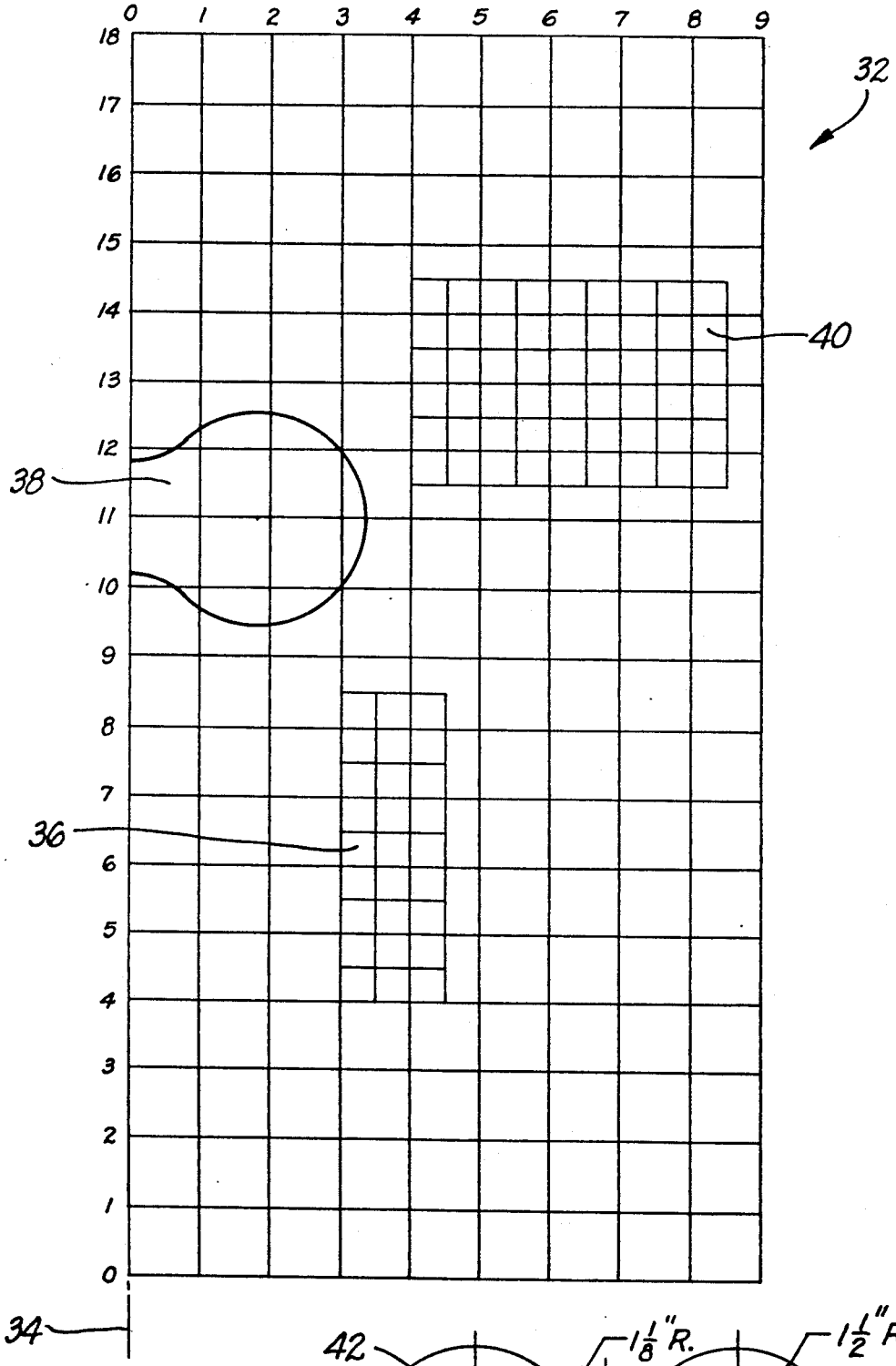
FIG. 5 is a diagram which, when considered in conjunction with the table in the specification, shows the elevation of the heights of the various portions of the surface of the cushion.

The surface contour is critical, and the location of the pressure reducing recesses and the pockets is critical. The surface contour is defined by the position chart 32 in FIG. 5, which shows the locations of various points on the seat. Center line 34 is seen in FIG. 1 and in the lower left of FIG. 5. This cushion, as seen in FIG. 1, is symmetrical around the center line 34. Therefore, only one side of the contour shape of the cushion need be shown in FIG. 5 because the other side is symmetrical. In FIG. 5, the lower left-hand, zero-zero corner is at the front edge of the cushion at the center thereof. The columns represent lateral measurements from the center line, and the columns are 1 inch apart. The rows represent measurements back from the front edge of the cushion and are also in 1 inch increments. In certain areas, to define the contours at the critical areas, dimensions are in ½ inch increments. Table 1, given below, represents height in inches above a horizontal reference plane.

TABLE 1

| ROW | | | | | | | | | | | | | | | | | | | |
|---|---|---|---|---|---|---|---|---|---|---|---|---|---|---|---|---|---|---|---|
| 0 | 1 | 2 | 3 | 3.25 | 3.5 | 3.75 | 4 | 4.25 | 4.5 | 5 | 5.5 | 6 | 6.5 | 7 | 7.5 | 8 | 8.5 | 9 | COL. |
| 4.95 | 5.00 | 5.07 | 5.12 | | | | 5.12 | | | 5.10 | | 5.05 | | 5.02 | | 4.97 | | 4.90 | 18 |
| 3.10 | 3.40 | 4.45 | 4.80 | | | | 5.07 | | | 5.12 | | 5.10 | | 5.10 | | 5.10 | | 4.62 | 17 |
| 1.27 | 1.25 | 1.30 | 1.97 | | | | 3.50 | | | 4.90 | | 5.07 | | 5.10 | | 5.10 | | 4.60 | 16 |
| 1.30 | 1.27 | 1.25 | 1.27 | | | | 1.50 | | 2.07 | 1.87 | 1.97 | 4.70 | 4.92 | 5.02 | 5.07 | 5.07 | 5.00 | 4.52 | 15 |
| | | | | | | | 1.45 | | 1.62 | 2.07 | 2.82 | 4.05 | 4.62 | 4.82 | 4.95 | 4.97 | 4.92 | | 14.5 |
| 1.35 | 1.32 | 1.30 | 1.27 | | | | 1.40 | | 1.62 | 1.82 | 2.22 | 3.07 | 3.97 | 4.35 | 4.72 | 4.87 | 4.82 | 4.37 | 14 |
| | | | | | | | 1.40 | | 1.60 | 1.80 | 2.05 | 2.45 | 3.20 | 3.82 | 4.50 | 4.72 | 4.77 | | 13.5 |
| 1.32 | 1.32 | 1.27 | 1.30 | | | | 1.40 | | 1.57 | 1.75 | 2.00 | 2.30 | 2.72 | 3.30 | 4.17 | 4.55 | 4.65 | 4.22 | 13 |
| | | | | | | | 1.45 | | 1.62 | 1.80 | 2.05 | 2.30 | 2.60 | 3.02 | 3.95 | 4.42 | 4.55 | | 12.5 |
| 1.32 | 1.32 | 1.32 | 1.35 | | | | 1.50 | | 1.65 | 1.82 | 2.12 | 2.30 | 2.60 | 2.90 | 3.80 | 4.30 | 4.45 | 4.02 | 12 |
| | | | | | | | 1.55 | | 1.70 | 1.90 | 2.70 | 2.40 | 2.65 | 2.87 | 3.67 | 4.20 | 4.35 | | 11.5 |
| 1.40 | 1.40 | 1.40 | 1.42 | | | | 1.62 | | 1.80 | 2.00 | 2.22 | 2.50 | 2.70 | 2.90 | 3.55 | 4.10 | 4.30 | 3.85 | 11 |
| | | | | | | | | | | | | | | | | | | | 10.5 |
| 1.62 | 1.60 | 1.57 | 1.62 | | | | 1.85 | | | 2.22 | | 2.62 | | 3.02 | | 3.87 | | 3.65 | 10 |
| | | | | | | | | | | | | | | | | | | | 9.5 |
| 2.00 | 1.90 | 1.85 | 1.92 | | | | 2.15 | | | 2.50 | | 2.80 | | 3.02 | | 3.72 | | 3.45 | 9 |
| | | | 2.07 | 2.12 | 2.15 | 2.20 | 2.30 | 2.35 | 2.42 | | | | | | | | | | 8.5 |
| 2.45 | 2.27 | 2.17 | 2.25 | 2.10 | 2.07 | 2.20 | 2.30 | 2.50 | 2.55 | 2.67 | | 2.85 | | 2.95 | | 3.55 | | 3.35 | 8 |
| | | | 2.40 | 2.27 | 2.20 | 2.32 | 2.35 | 2.62 | 2.65 | | | | | | | | | | 7.5 |
| 2.82 | 2.62 | 2.50 | 2.52 | 2.47 | 2.37 | 2.35 | 2.45 | 2.47 | 2.67 | 2.72 | | 2.80 | | 2.85 | | 3.35 | | 3.15 | 7 |
| | | | 2.60 | 2.47 | 2.40 | 2.40 | 2.50 | 2.57 | 2.72 | | | | | | | | | | 6.5 |
| 3.05 | 2.85 | 2.60 | 2.65 | 2.55 | 2.47 | 2.50 | 2.55 | 2.57 | 2.70 | 2.72 | | 2.75 | | 2.77 | | 3.25 | | 3.02 | 6 |
| | | | 2.65 | 2.65 | 2.52 | 2.50 | 2.60 | 2.60 | 2.70 | | | | | | | | | | 5.5 |
| 3.12 | 2.95 | 2.65 | 2.67 | 2.67 | 2.57 | 2.55 | 2.60 | 2.60 | 2.70 | 2.72 | | 2.75 | | 2.77 | | 3.17 | | 2.90 | 5 |
| | | | 2.67 | 2.67 | 2.55 | 2.60 | 2.60 | 2.60 | 2.70 | | | | | | | | | | 4.5 |
| 3.12 | 2.95 | 2.65 | 2.65 | 2.65 | 2.65 | 2.65 | 2.65 | 2.65 | 2.65 | 2.65 | | 2.67 | | 2.70 | | 3.05 | | 2.72 | 4 |
| 3.15 | 2.95 | 2.57 | 2.57 | | | | 2.57 | | | 2.60 | | 2.60 | | 2.60 | | 2.87 | | 2.57 | 3 |
| 3.12 | 2.95 | 2.60 | 2.50 | | | | 2.50 | | | 2.50 | | 2.52 | | 2.52 | | 2.75 | | 2.40 | 2 |
| 2.90 | 2.80 | 2.45 | 2.30 | | | | 2.30 | | | 2.30 | | 2.32 | | 2.35 | | 2.52 | | 2.20 | 1 |
| 1.15 | 1.15 | 1.15 | 1.15 | | | | 1.15 | | | 1.15 | | 1.15 | | 1.15 | | 1.15 | | .50 | 0 |

Figure 6:
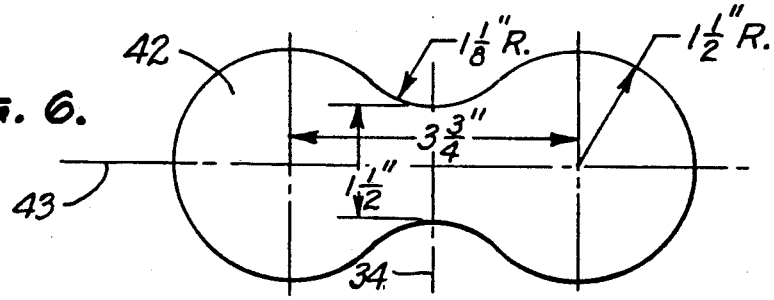
FIG. 6 is an enlarged detail showing the ischial area of the cushion.

Table 1 and FIGS. 1, 5 and 6 define the location and contour of the sciatic area 36, ischial area 38 and trochanter area 40. In the first preferred embodiment of the cushion of my invention, the sciatic area 36 and trochanter area 40 are recesses below the adjacent general contour, while the ischial area 38 comprises a pocket. Referring to FIG. 2, ischial pocket 42 is formed by a recess in the top 22. The pocket has side walls and a bottom 44. As indicated in FIG. 2, the bottom 44 of the pocket may lie against the bottom of the seat base. Within the pocket, there is an ischial cushion 46 which comprises an open cell foam which completely fills the pocket. The foam cushion layer 26 is cut out at the ischial pocket and the ischial cushion extends up through the cut-out area. The foam of the ischial cushion is of such strength as to apply a pressure in the ischial area of about 25 mm of mercury when compressed. This pressure is high enough to prevent extrusion of tissues into the ischial pocket, but low enough to permit circulation below the ischial tuberosities in order to avoid ulceration. In this way, the pressure is controlled in the ischial pocket to provide necessary support to avoid extrusion into the recess and yet limit the pressure so that ulceration in that area is avoided. The size of the ischial pocket 42 is shown in FIGS. 5 and 6 where the center line through the pocket is the center line 34 and the transverse center line 43 is the 11 inch line.

The sciatic area 36 and the trochanter area 40 also have reduced pressure thereon by means of the contour of the top 22 of the cushion base. The reduced height in these critical areas reduces the local surface pressure on the seated person. The sciatic recess 36 is seen in FIGS.

1 and 2, and both recesses are shown when Table 1 is used to refer to FIG. 5.

Figure 4:
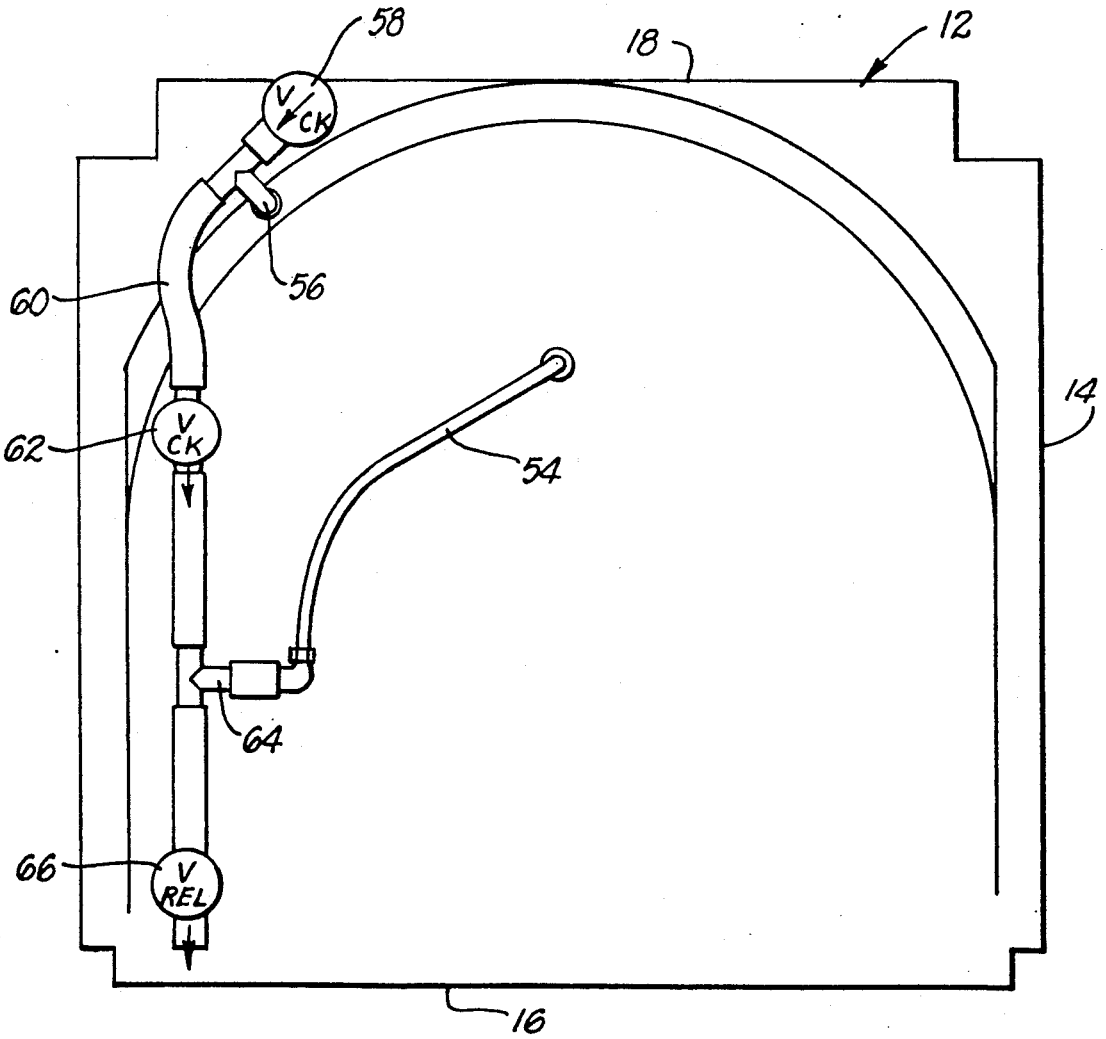
FIG. 4 is a bottom view showing the pneumatic connection of the second preferred embodiment of the cushion of this invention.

As a second preferred embodiment of our invention, the base 12 has a back recess below the surface 24 which forms a pocket 48, which is positioned behind the lower back. From the pocket 48, as seen in FIGS. 1 and 2, it is apparent that the seated person's lower back is positioned adjacent thereto. The foam cushion layer 26 may extend over the recess. Within the recess is a back cushion 50. The back cushion 50 is open cell foamed synthetic polymer composition material, which is available for upholstery purposes. The cushion is enclosed in a flexible film cover 52, which encloses the cushion. The film cover may be any substantially air-impervious synthetic polymer composition flexible film, such as vinyl. In this case, the ischial cushion 46 is also covered with a substantially impermeable flexible polymer film, such as vinyl. Both of the cushions have tubes attached thereto. As seen in FIG. 4, ischial tube 54 is connected to ischial cushion 46. Back tube 56 is connected to back cushion 50. FIG. 4 shows the interconnecting tubing, which includes an intake check valve 58 connected to delivery tube 60. The delivery tube 60 is connected by a tee to back tube 56. Delivery tube 60 is connected through check valve 62 through tee 64 to relief valve 66. Ischial tube 54 is also connected to the tee 64.

By this construction, as the sedentary person moves on his cushion, the back cushion 50 is compressed and released. As it is released, the foam expands the envelope to draw in air through check valve 58 and tube 56. As the seated person moves back, he compresses the cushion 50 expelling air which passes through check valve 62 and pressurizes ischial tube 54. In this way, the ischial envelope is expanded. In order to limit the maximum pressure in the ischial envelope, relief valve 66 limits the pressure in the ischial envelope to 25 mm Hg in order to provide support under the ischial tuberosities sufficiently high to prevent extrusion and sufficiently low to prevent ulceration. The ischial cushion 46 remains in the ischial envelope for the case where there may be inadequate pumping or there may be air leakage, to maintain the minimum pressure on the ischia. By this construction, the pressure under the ischia varies between the minimum and maximum limits in order to stimulate circulation under the ischia.

Figure 7:
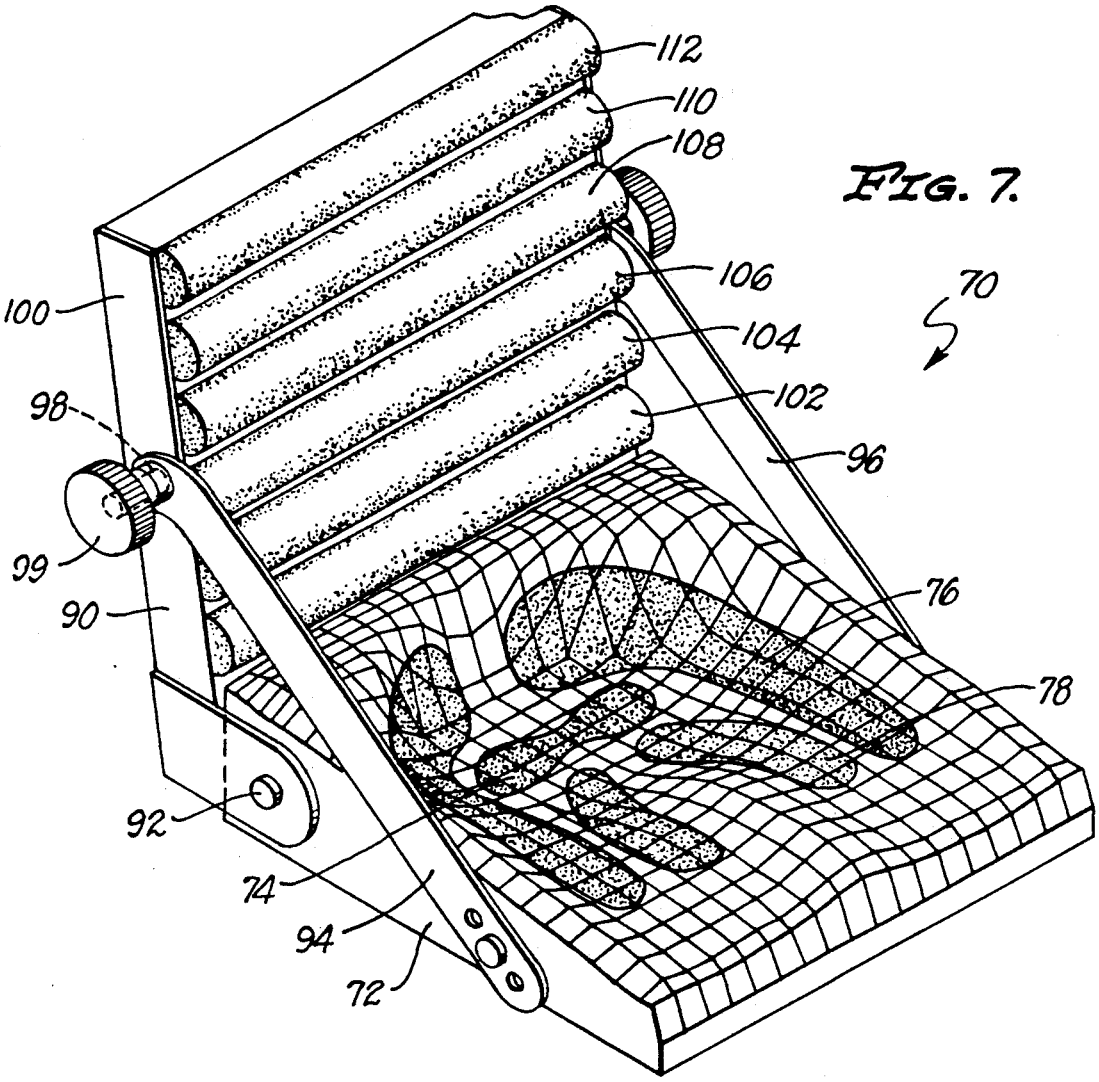
FIG. 7 is an isometric view of a second preferred embodiment of the cushion of this invention, showing it also equipped with a backrest.
Figure 8:
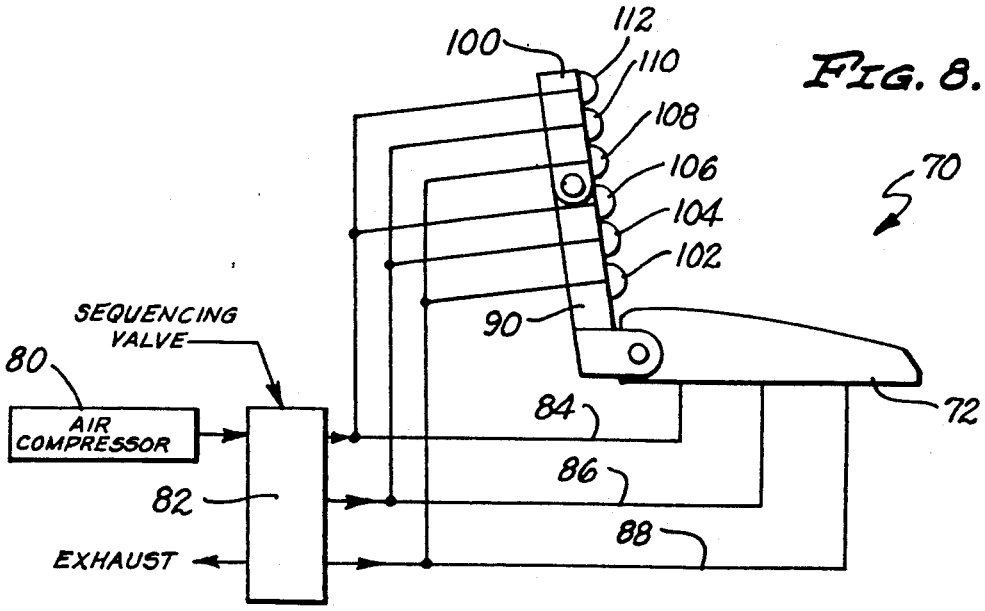
FIG. 8 is a pneumatic diagram showing the sequencing of the various bladders beneath the cushion surface.

The third preferred embodiment of the cushion of this invention is generally indicated at 70 in FIGS. 7 and 8. A base 72 has a contoured top surface with the same contour. The contoured top surface is covered with foam, an impermeable layer, and a washable layer, the same as that described with respect to FIG. 3. The base contains therein an ischial bladder 74, an outer thigh bladder 76, and an inner thigh bladder 78. These bladders are symmetrical on both sides of the central plane.

Each of the bladders is formed of two layers of flexible impermeable synthetic polymer composition film, such as vinyl sheet. The bladders are sealed together around their peripheral edges so that each is in the form of a flat envelope that lies on top of the base surface and under the cushion foam or on top of the cushion foam. They take substantially no space in the uninflated condition. Each of the bladders is pneumatically connected. Referring to FIG. 8, air compressor 80 supplies air through air-sequencing valve 82. The function of the sequencing valve 82 is to sequentially connect pneumatic lines 84, 86 and 88 alternately to air pressure at a controlled value and to exhaust. The connections are sequential so that the bladders are successively pressurized and exhausted. In this way, the bladders 74, 76 and 78 successively raise and lower their corresponding areas. It is to be noted that the outer and inner thigh bladders are respectively inward and outward of the sciatic area so that the thighs are clasped and raised to limit pressure in the ischial area. As seen in FIG. 7, the ischial bladder 74 is the same shape as the ischial bladder in FIG. 6, but the outer thigh and buttocks bladder 76 extends farther forward and backward around the outer contour of the cushion than the trochanter recess 40. Outer thigh bladder 76 provides trochanter relief, but additionally raises the thigh to limit pressure in the sciatic and ischial area. Pneumatic lines 84, 86 and 88 respectively connect to the ischial bladder 74, the inner thigh bladder 78 and the outer thigh bladder 76.

Back support is also helpful, but it is optional to the contoured cushion with its pressure-limited bladders. As seen in FIG. 7, back 90 is pivoted on base 72 on pivot pin 92 so that the back angle can be adjusted. The back is retained in the desired back angle by straps 94 and 96, which are secured at their upper ends to the back and their lower ends have provisions for adjustment. In the illustrated case, the adjustment is the placement of different holes in the strap over a pin extending from the base. It is also desirable to have a two-piece back. As indicated, the lower back is pivoted on pin 92. The upper back is pivoted on pin 98, which also anchors the top ends of the straps. The upper section 100 of the back 90 can, thus, be pivoted independently of the lower section and secured in place by clamp knob 99. This permits individual adjustment for optimum support of the lower and upper back. The pivot pin 98 is preferably at approximately the height of the top of the hip bones. The lower back has three cushions 102, 104 and 106 thereon. In addition, the upper back 100 has three back cushions 108, 110 and 112 thereon. Each of these cushions is an envelope or a bladder of flexible air-impervious film, such as flexible synthetic polymer film, for example vinyl. Each preferably contains therein a hemicylindrical rod of open cell foam to maintain some cushioning in the event of air pressure failure. The flat side of the rod is toward the back. These rods maintain a generally hemi-cylindrical configuration of the back cushions. The back cushions lie adjacent to each other and comfortably support the back due t the resilient open cell foam therein. In themselves, they are comfortable back support. However, each of the cushions is connected to one of the pneumatic lines 84, 86 and 88, as shown in FIG. 8. Thus, the back cushions are sequentially pressurized and vented to provide a variation in pressure over the various portions of the user's back. This stimulates circulation in the back.

By means of properly contouring the cushion, relieving areas where equal stress may cause trouble, but maintaining sufficient pressure to prevent extrusion damage, a cushion which can be used for a long period is created.

This invention has been described in its presently contemplated best mode for a large wheel chair. The measurements in FIG. 5 together with Table 1 relate to an 18 inch square cushion size which is commonly defined as large. The ratios relative to sizes for a small wheel chair (a 14 inch cushion), a medium wheel chair (a 16 inch cushion), and an extra large wheelchair (a 20 inch cushion) are to the most extent simply scaled proportionately. It is clear that this invention is susceptible to numerous modifications, modes and embodiments within the ability of those skilled in the art and without the exercise of the inventive faculty. Accordingly, the scope of this invention is defined by the scope of the following claims.

What is claimed is:

1. A cushion comprising:

a substantially rigid base, said substantially rigid base having a contoured top surface, said contoured top surface being configured for seating by and grasping of the posterior of a sedentary person;

a resilient cushion layer of substantially uniform thickness on said top surface of said base;

a recess in said cushion layer under areas of the seated person less tolerant of seating pressure;

a cover layer on said cushion layer and over said recess;

an envelope in said recess, foam synthetic polymer composition material in said envelope to expand said envelope to create pressure in said envelope; and fluid pressure means connected to said envelope to regulate the amount of pressure said envelope exerts in said recess to control the amount of pressure at said recess exerted on that portion of the sedentary person.

2. The cushion of claim 1 wherein said foam in said envelope exerts a greater pressure than said cushion layer and said fluid pressure means produces in said envelope a pressure below atmospheric pressure.

3. A cushion comprising:

a substantially rigid base, said substantially rigid base having a contoured top surface configured to comfortably support the posterior including the bony structure therein of a seated person, said substantially rigid base being configured to grasp the buttocks and position the seated person thereon;

a resilient cushion layer of substantially uniform thickness over said entire contoured base surface;

walls in said base and in said cushion layer defining a recess beneath the ischia of the seated person, an ischial cushion in said ischial recess, said ischial cushion being enclosed within an ischial envelope of substantially air-impervious flexible synthetic polymer composition material film, said ischial cushion substantially reaching said contoured surface, said ischial cushion providing a counter-pressure at the ishia to compress soft ischial tissue in a manner to retard settling of the bony structures so as to minimize pressure and pressure gradients around the seated person's ischial protuberances; and said surface being shaped to grasp the sides and back of the buttocks of a seated person and a back recess at the back of said contoured surface of said base behind said ischial recess and an envelope in said back recess to substantially fill said back recess, said envelope containing a back cushion of open cell synthetic polymer foam, said back envelope being connected to said ischial envelope.

4. The cushion of claim 3 wherein said ischial envelope has pneumatic pressure therein and a relief valve is connected to said ischial envelope to limit the pneumatic pressure in said ischial envelope to a value lower than the pressure against the portion of the posterior sitting on the adjacent cushion.

5. A cushion comprising:

a substantially rigid base, said substantially rigid base having a contoured top surface, said top surface being contoured to grasp and compressively fit the posterior of a seated person;

a resilient cushion layer of substantially uniform thickness of foam synthetic polymer composition material covering said contoured surface;

said contoured top surface being depressed under the sciatic area of the seated person;

an ischial recess in said contoured top surface under the ischial protuberances of the seated person, a resilient ischial cushion in said ischial recess, said ischial cushion being sufficiently soft so as to limit the contact pressure over the ischial recess to no more than about 25 mm Hg, said ischial cushion being an open cell foam synthetic polymer composition material and said open cell foam synthetic polymer composition material is enclosed in an envelope made of flexible synthetic polymer composition film so as to form an ischial envelope, said ischial cushion being of greater resiliency than the resiliency of the cushion layer in order to reduce the pressure on a seated person over the ischial recess.

6. The cushion of claim 5 wherein said ischial envelope is pneumatically connected to limit the pressure in said ischial envelope and thus limit the pressure below a seated person's ischial protuberances.

7. The cushion of claim 6 further including a pneumatic pressure source to supply air under pressure to said ischial envelope.

8. The cushion of claim 7 wherein said pneumatic pressure source includes a sequencing valve connected to said ischial envelope to vary the pressure in said ischial envelope.

9. The cushion of claim 8 further including additional envelopes connected to said sequencing valve for sequential pressurization and venting.

10. The cushion claim 9 further including a back pivoted thereto and said back has pneumatic back cushions thereon, said back cushions being connected to said sequencing valve.

11. A cushion comprising:

a substantially rigid base, said substantially rigid base having a contoured top surface, said contoured top surface being configured for seating by and grasping of the posterior of a sedentary person having posterior ischial protuberances;

a recess in said top surface under the ischial protuberances of a seated person;

a resilient cushion layer over said contoured top surface and over said ischial recess;

an envelope in said recess and open cell synthetic polymer composition material in said envelope;

a plurality of bladders over said cushion layer;

a source of air under pressure, a sequencing valve connected to said envelope and to said source of air under pressure and connected to each of said bladders for sequentially pressurizing said envelope and said bladders to change the pressure under different portions of the posterior and thighs of the seated person.

12. The cushion of claim 11 wherein said bladders include a inner thigh bladder and an outer thigh bladder with a space therebetween beneath the sciatic area of a sedentary person each of said bladders being connected to said sequencing valve so that said sequencing valve changes the pressure under various portions of the posterior.

13. The cushion of claim 11 wherein said bladders are flat when uninflated and are made of substantially impermeable layers of flexible synthetic polymer composition material sheet.

14. The cushion claim 13 further including a back pivoted thereto and said back has pneumatic back cushions thereon, said back cushions being connected to said sequencing valve.

* * * * *